US005148913A

United States Patent [19]

Bonnardel et al.

[11] Patent Number: 5,148,913

[45] Date of Patent: Sep. 22, 1992

[54] OPERATING MECHANISM OF A THREE-POSITION SWITCH

[75] Inventors: Patrick Bonnardel; Jacques Vernay, both of Grenoble; Hugues Filiputti, Monestier De Clermont; Thierry Humbert, St. Martin D'Heres; Marcel Rigaud, Izeaux, all of France

[73] Assignee: Merlin Gerin, France

[21] Appl. No.: 668,163

[22] Filed: Mar. 12, 1991

[30] Foreign Application Priority Data

Mar. 22, 1990 [FR] France ..... 90 03794

[51] Int. Cl.[5] ..... H01H 5/06

[52] U.S. Cl. ..... 200/400; 200/148 F

[58] Field of Search ..... 200/400, 401, 411, 415, 200/424, 440, 148 F

[56] References Cited

U.S. PATENT DOCUMENTS 3,959,615 5/1976 Zaffrann, Jr. et al. .

4,916,268 4/1990 Micoud et al. ..... 200/400

FOREIGN PATENT DOCUMENTS 0055585 8/1982 European Pat. Off. .

2606209 5/1988 European Pat. Off. .

0286474 10/1988 European Pat. Off. .

*Primary Examiner*—Harold Broome

*Attorney, Agent, or Firm*—Parkhurst, Wendel & Rossi

[57] ABSTRACT

An operating mechanism of a three-position switch having a contact-bearing main shaft comprises a switch closing and opening operation device, and an earthing device closing and opening operating device. The two devices comprise driving flange plates connected by a common spring capable of being loaded by rotation of either of the operating shafts and transmitting, after the deadpoint has been reached, a drive movement of these flange plates transmitted by articulated levers to a crank handle wedged onto the main shaft. All the operations are high-speed and the torque transmitted to the main shaft increases in the course of the operating movement. A locking device maintains the main shaft in the open position during the loading phase of the spring.

7 Claims, 6 Drawing Sheets

OPERATING MECHANISM OF A THREE-POSITION SWITCH

BACKGROUND OF THE INVENTION

The present invention relates to an operating mechanism of an electrical switch with a main shaft bearing or actuating contacts and capable of being selectively moved to three stable positions, a central open position, a closed position of the switch and a closed position of the earthing device on opposite sides of the open position main shaft being connected by toggle levers to a first switch closing and opening operating device and to a second earthing closing and opening operating device.

A state-of-the-art operating mechanism of the kind mentioned comprises two independent operating devices, one for closing and opening of the switch and the other for closing and opening of the earthing device. Each of these tumbler type devices is provided with a spring and interlock systems prevent any operating errors, notably closing of the earthing device when the switch is closed. These devices are complicated and of uncertain reliability.

The object of the invention is to achieve a simplified high-speed operating mechanism of an electrical switch with built-in self-locking.

SUMMARY OF THE INVENTION

The operating mechanism according to the invention is characterized in that first and second operating devices cooperate with a spring imposing high-speed operations of said main shaft and that toggle levers transmit to the main shaft a torque increasing from the central position to the closed positions of the switch and earthing device to reach the deadpoint stably locking the main shaft in the latter positions.

The mechanism can operate a three-pole switch of the type described in EP Pat. Appln. No. 270389, wherein the main shaft bears three contact bridges which cooperate with stationary contacts arranged on the periphery of the switch enclosure. The central position of the main shaft corresponds to opening of the switch which can be closed by a rotation of this main shaft in a predetermined direction. Reverse rotation of the main shaft from the open position of the switch corresponds to earthing, in a manner well-known to those specialized in the art.

According to the present invention, the closing and opening operation of the switch is controled by alternate rotation of a first operating shaft, notably by an operating lever, whereas the closing and opening operation of the earthing device is controled by a second shaft, notably by means of an operating lever.

Rotation of the operating shaft results in loading of the spring, which moves the main shaft at high speed as soon as the deadpoint is reached to perform a high-speed operation. Each operating shaft bears a flange plate with an eccentric crankpin and the spring is inserted between the two crankpins to drive the flange plate selectively as soon as the deadpoint is reached.

The connection between the operating shaft and the flange plate comprises an aperture to allow a dead travel discoupling the flange plate from the operating shaft during the high-speed movement phase generated by the relaxation or unloading of the spring. The main shaft bears a crank handle whose end is connected by two connecting rods which are in turn connected to two sectors rotatably mounted coaxially on the two operating shafts. Each sector cooperates with the associated flange plate by a connection having dead travel enabling the sector to be driven positively by the flange plate during the relaxation travel of the spring. The connecting rod or articulated lever constitutes, with the associated sector, a toggle whose levers are appreciably perpendicular in the open position of the switch, these levers coming in the deadpoint position to the closing position providing positive locking of the main shaft. Rotation of the sector in the closing direction is limited by a stop. The crank handle constitutes a toggle with each connecting rod. The assembly is arranged in such a way that in the closed position of the switch, any action exerted on the earthing operating shaft tends to accentuate closing of the switch, and vice-versa. In the open position of the switch each flange plate cooperates with a stop limiting the rotation due to the action of the spring.

The flange plates bear cams controlling locking levers arranged to lock the main shaft in the open position during the loading phase of the spring. At the end of loading travel of the spring, the corresponding cam actuates the locking lever so as to enable rotation of the main shaft in the direction imposed by the spring after the deadpoint has been reached. This locking device prevents any untimely rotation of the main shaft during the loading phases. This locking device also prevents any rebound on opening of the switch.

The mechanism comprises an additional safety device formed by an interlock arm preventing operation of the earthing device when the switch is closed and vice-versa. This interlock arm cooperates with the operating shafts, for example, by preventing the operating lever from being placed. The mechanism can be motor-driven by coupling a motor with alternate directions of rotation to the switch operating shaft, this motorization being favored by dead travel allowing progressive shutdown of the motor after the loading phase of the spring.

BRIEF DESCRIPTION OF THE DRAWINGS

Other advantages and features will become more clearly apparent from the following description of an illustrative embodiment of the invention, given as a non-restrictive example only and represented in the accompanying drawings, in which.

DESCRIPTION OF THE PREFERRED EMBODIMENT

Figure 1:
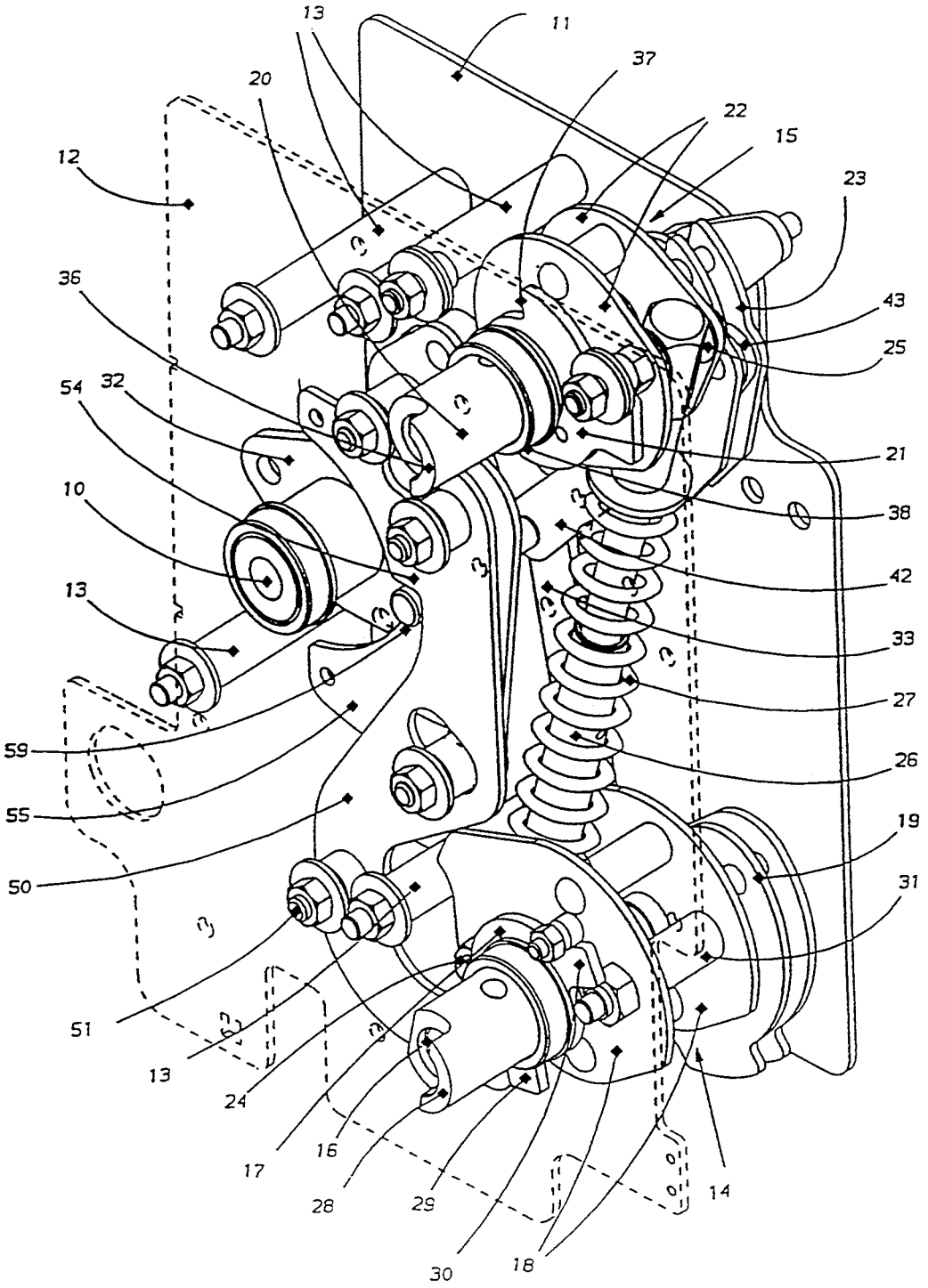
FIG. 1 is a schematic perspective view of a mechanism according to the invention, the front flange being represented by its outline in broken lines and the switch being in the open position.

In the figures, a main shaft 10 is mounted with rotation between two flanges 11, 12 securedly united by spacers 13. The main shaft 10 can be coupled or constitute a contact-bearing shaft of a three-position switch for example of the type described in French Patent No. 2,606,209. The man shaft 10 can occupy three distinct stable positions, a central position C1 corresponding to the open position and, on either side, a switch closing position C2 and an earthing position C3. The positions C2 and C3 are symmetrical from C1 with an angular displacement of 60° but other values can be used. The main shaft 10 is mechanically connected on the one hand to an operating device 14 controling closing and opening of the switch and on the other hand to an earthing operating device 15 controling closing and opening of the earthing device.

The switch operating device 14 comprises an operating shaft 16 on which there are mounted in rotation a driver 17, a pair of flange plates 18 and a section 19.

Similarly the earthing operating device 15 comprises an operating shaft 20 on which there are mounted in rotation a driver 21, a pair of flange plates 22 and a sector 23.

An eccentric crankpin 24 is inserted and securedly united to the pair of switch operating flange plates 18 whereas an eccentric crankpin 25 is inserted and securedly united to the pair of earthing operating flange plates 22. A telescopic rod 26, articulated by its ends on the crankpins 24, 25, bears a compression spring 27 urging the crankpins 24, 25 to the separated position. The driver 17 of the switch operating device bears at its free end a coupler 28 of an operating lever (not shown) and at its end adjacent to the flange plate 18 two drive fingers 29, 30 located with clearance on either side of a spindle 31 borne by the pair of flange plates 18. The opposite end of the spindle 31 is engaged in a circular aperture 62 provided in the sector 19. The sector 19 is mechanically connected to a crank handle 32, keyed onto the main shaft 10, by a lever 33 articulated on the crank handle 32 by a toggle 34 and articulated on the sector 19 by a toggle 35. It can easily be seen that rotation of the driver 17 brings about movement with clearance of the spindle 31 and associated flange plates 18 and rotation of the sector 19 transmitted by the articulated lever 33 to the crank handle 32 and main shaft 10.

In a similar manner to that described above the driver 21 of the earthing device 15 bears at its free end a coupler 36 of an operating lever (not shown). The opposite end of the driver 21 bears two stops 37, 38 located with clearance on either side of a spindle 39 borne by the pair of flange plates 22. The opposite end of the spindle 39 is inserted with clearance between two stopping surfaces 40, 41 borne by the sector 23. The sector 23 is mechanically connected to a crank handle 32 by an articulated lever 42 one end of which is mechanically connected to the toggle 34 of the crank handle 32 and the other end of which is articulated on the toggle 43 of the sector 23. Rotation of the driver 21 brings about movement of the spindle 39 with the flange plates 22 and rotation of the sector 23 which is transmitted by the lever 42 to the crank handle 32 and main shaft 10.

Figure 2:
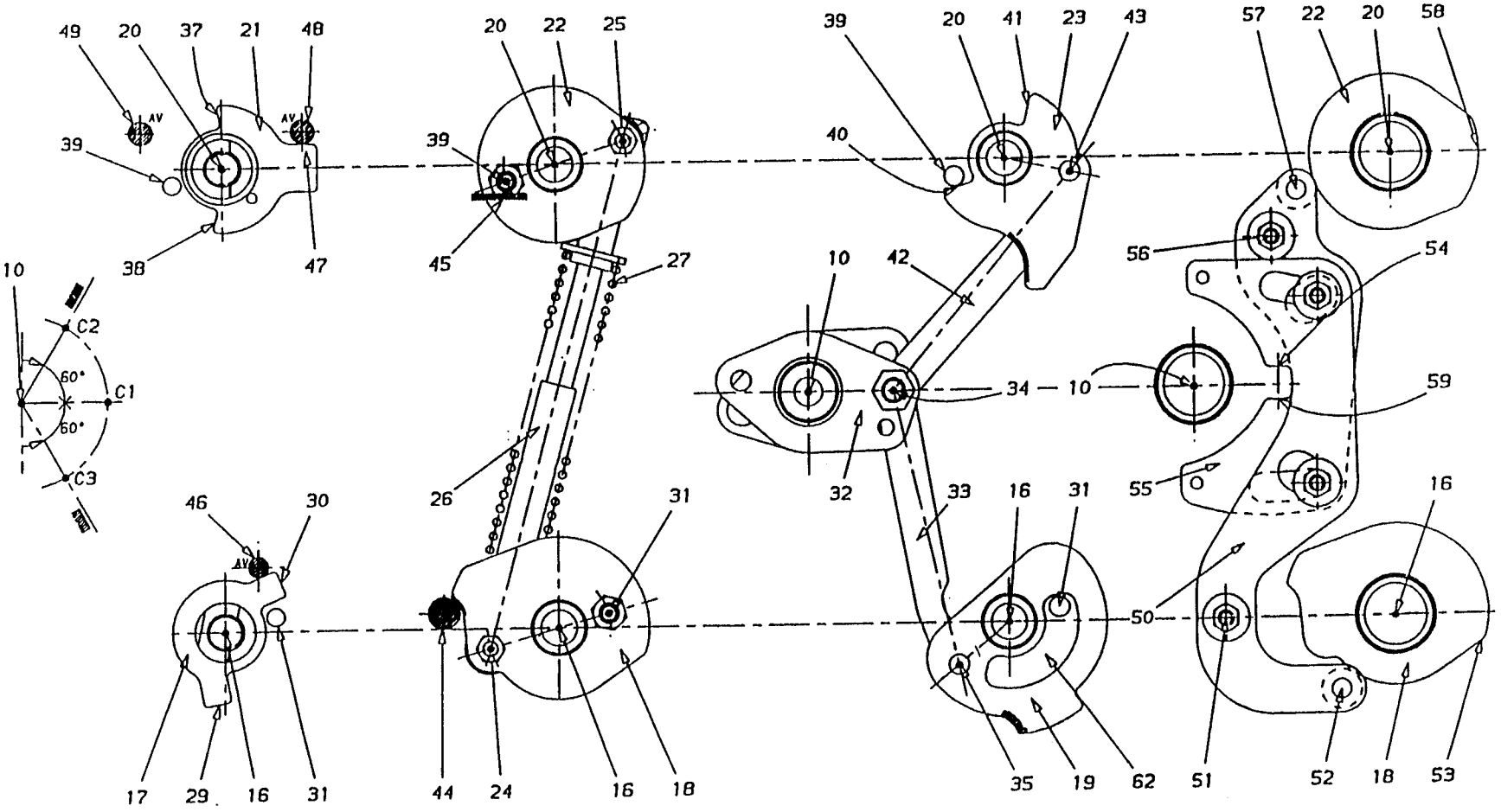
FIG. 2 is an exploded view of the mechanism according to FIG. 1 showing the respective positions of the different components.

In the open position of the switch, represented in FIG. 2, the spring 27 urges the pair of flange plates 18 counterclockwise up against a fixed stop 44. The line of action of the spring 27 is appreciably perpendicular to the radius of the flange plate 18 via the crankpin 24. The spring 27 similarly urges the pair of earthing device flange plates 22 counterclockwise bringing the spindle 39 up against a fixed stop 45. The spindle 31 at the bottom of the aperture 62 prevents any clockwise rotation of the sector 19 and thereby any counterclockwise rotation of the crank handle 32 and main shaft 10. The sector 23 up against the spindle 39 is prevented from turning clockwise and thereby prevents any clockwise rotation of the crank handle 32 and main shaft 10. The finger 30 of the driver 17 cooperates with a fixed stop 46 whereas rotation of the driver 21 is limited by a spigot 47 cooperating with two fixed stops 48, 49.

The crankpin 24 of the crank handle 32 cooperates with a locking device formed by a first lever 50 pivoting on a fixed spindle 51, one of the ends of which bears a roller 52 cooperating with the external surface of the flange plate 18 arranged as a cam 53 and the opposite end of which bears a stopping surface 54 preventing counterclockwise rotation of the crank handle 32. The crankpin 24 cooperates with a second locking lever 55 pivoting on a fixed spindle 56 and one of the ends of the second lever 55 bears a roller 57 engaged by the external surface of the flange plate 22 arranged as a cam 58. The opposite end of the lever 55 bears a stopping surface 59 preventing, in the locked position, clockwise rotation of the crank handle 32.

The mechanism operates as follows :

Closing of the switch (FIGS. 1 to 4).

The mechanism being in the open position, represented in FIGS. 1 and 2, the operating lever is coupled to the driver 17 of the switch operating shaft 16. Clockwise rotation of the operating lever and driver 17 brings about movement of the spindle 31 and clockwise rotation of the pair of flange plates 18 resulting in compression of the spring 27 during the loading phase of the latter represented in FIG. 3.

During this loading phase, the spindle 31 moves in the aperture 62 without moving the sector 19, the crank handle 32 remaining in the central position locked by the stopping surfaces 54, 59 on either side of the crankpin 24 in position C1. At the end of the loading phase of the spring 27, corresponding to alignment of the shaft 16 and crankpins 24, 25.

Figure 3:
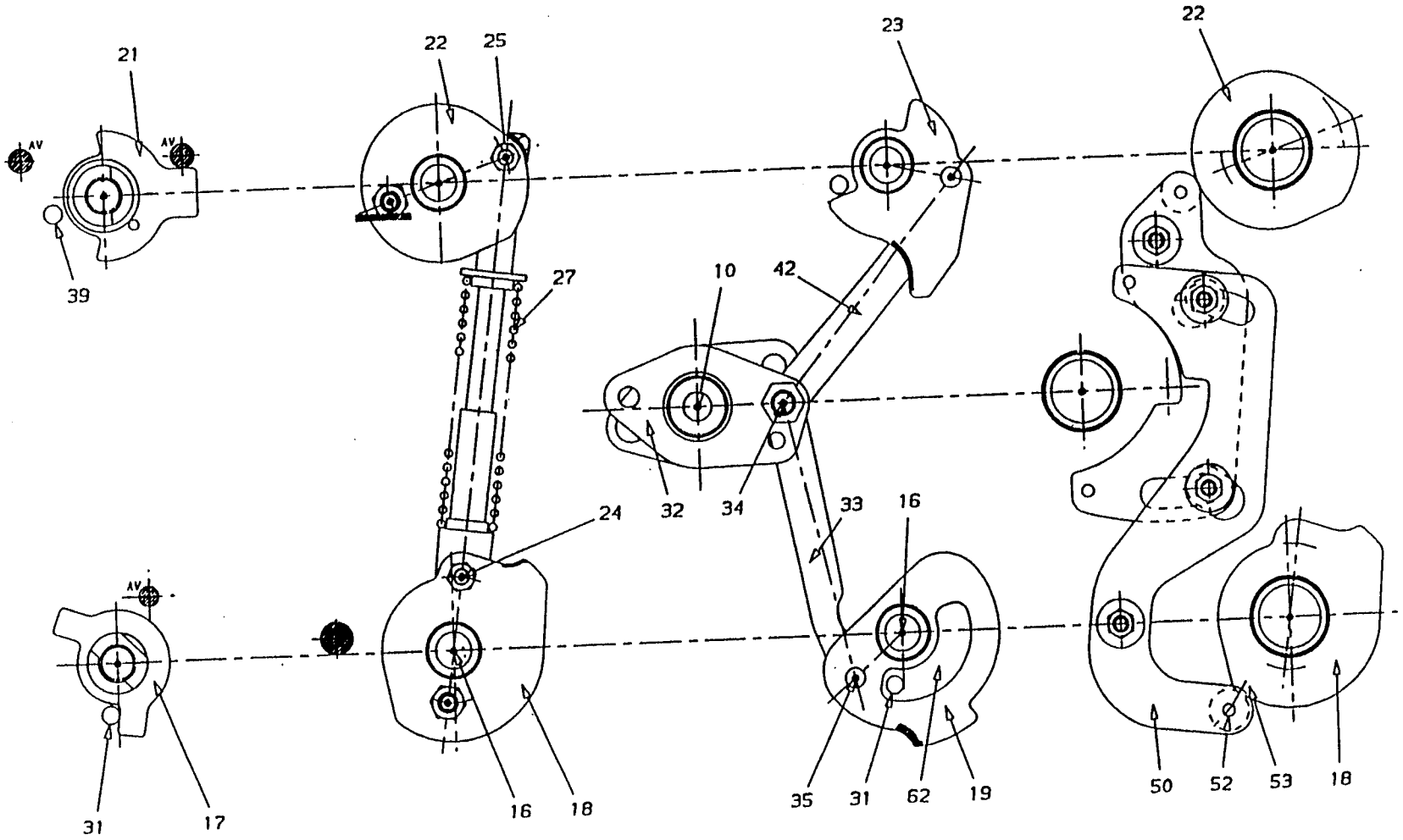
FIGS. 3, 4, 5 and 6 are similar views to those of FIG. 2 showing the mechanism respectively in the course of loading of the spring to close the switch; in the closed position of the switch; in the course of loading of the spring for earthing; and the earthing position.

The spring 27 becomes motive and as soon as the deadpoint is reached drives the pair of flange plates 18 in high-speed rotation independently from the driver 17. This high-speed rotation of the pair of flange plates 18 is transmitted by the spindle 31, which has reached the bottom of the aperture 62, to the sector 19 the clockwise pivoting of which is transmitted by the articulated lever 33 to the crank handle 32 and main shaft 10 which pivots counterclockwise to the closed position C2 of the switch, represented in FIG. 4. This pivoting was enabled by overriding of the stopping surface 54 due to the action of the cam 53 on the roller 52 at the end of the loading travel of the spring 27 (FIG. 3).

Figure 4:
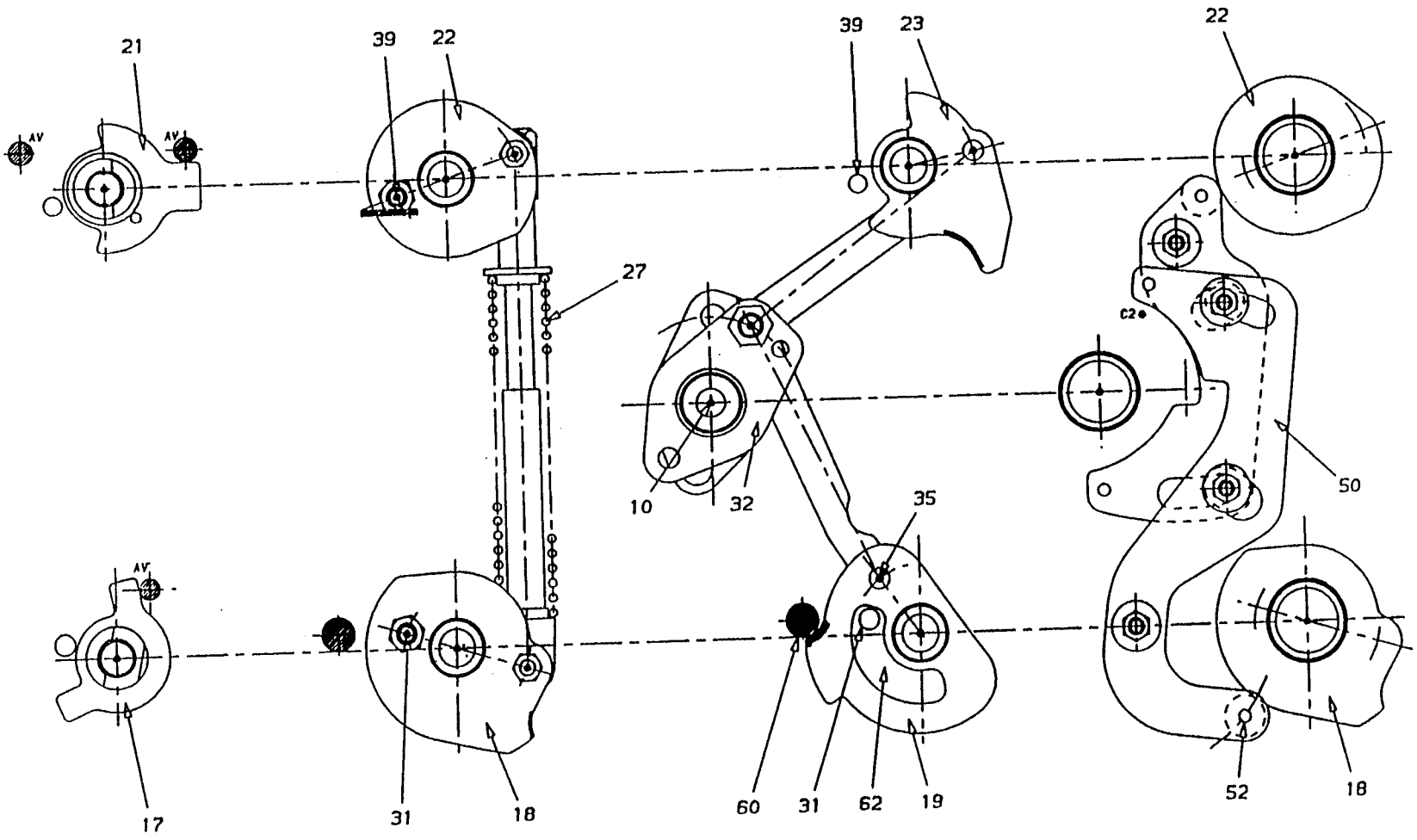

During the closing travel, the levers articulated by the toggle 35, i.e. the radius of the sector 19 passing through the toggle 35 and articulated lever 33, move from an almost perpendicular position to an alignment position represented in FIG. 4. Pivoting of the sector 19 is in addition limited by a stop 60. The torque transmitted to the crank handle 32 increases with pivoting towards the closed position of the switch.

During this closing travel, the articulated lever 42 of the earthing device pivots slightly and transmits to the associated sector 23 a movement limited by the relative positions of the sector 23 and articulated lever 42. This limited movement is compensated by the clearance between the stopping surfaces 40, 41 and the spindle 39. The earthing device 15 is otherwise unaffected by the closing operation of the switch.

Opening of the switch:

Starting from the closed position represented in FIG. 4, the driver 17 merely has to be actuated counterclockwise by the operating lever to drive the spindle 31 by the finger 29 bringing about a counterclockwise rotation of the pair of flange plates 18 to the loaded position of the spring 27 represented in FIG. 3. During this loading phase, the spindle 31 slides in the aperture 62 without the sector 19 moving. As soon as the deadpoint is reached, the spring 27 becomes active and makes the flange plate 18 turn which drives the sector 19 counterclockwise via the spindle 31. This rotation is transmitted by the articulated lever 33 to the crank handle 32 and main shaft 10 which returns to the position illustrated in FIG. 2. As soon as the loading phase of the spring 27 is completed, the cam 53 releases the locking lever 50 which returns by any suitable means, for example a spring (not shown), to the locking position to imprison the crankpin 24 which has returned to the open position. This locking device prevents any rebound on opening of the switch.

Figure 5:
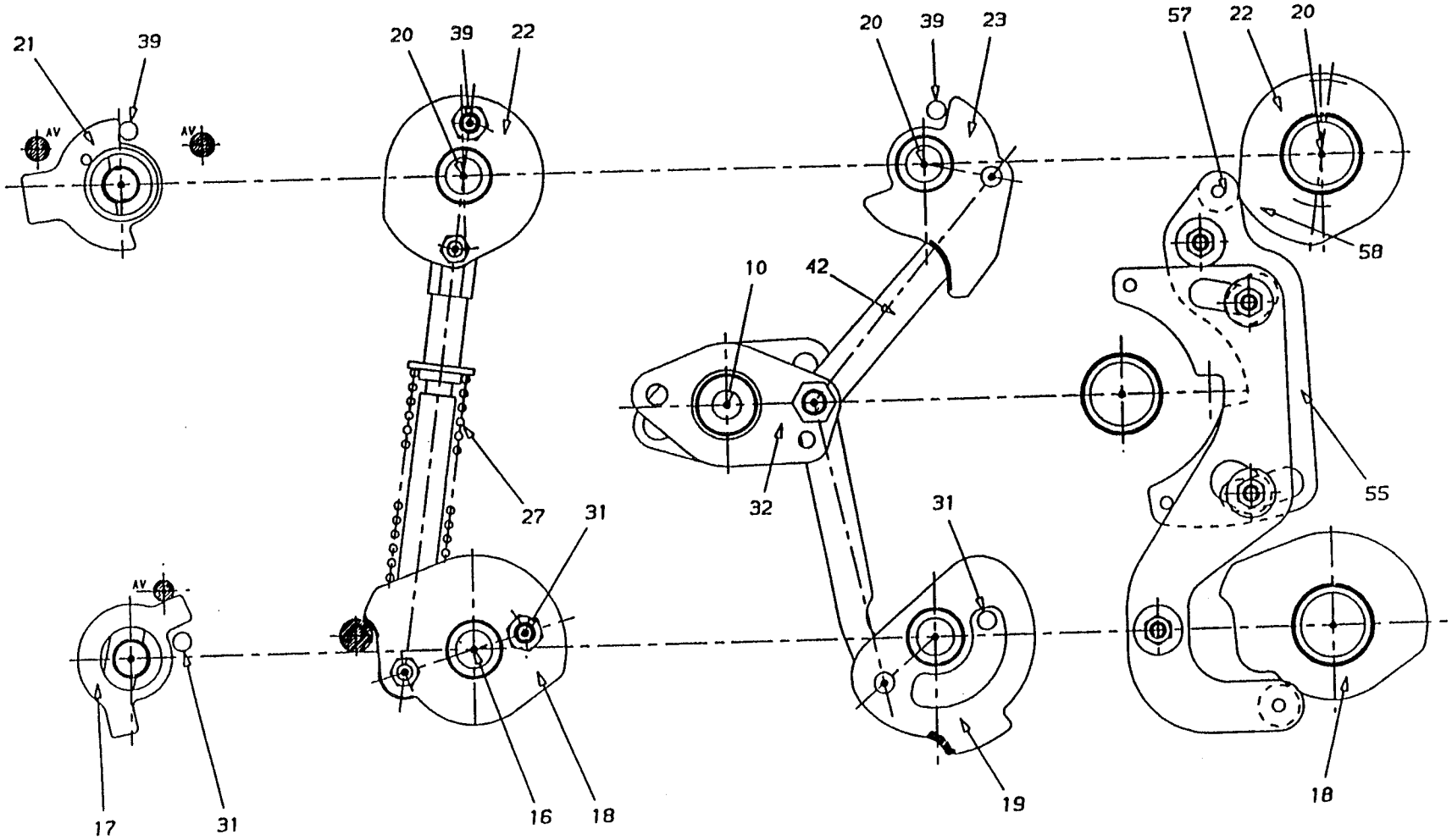
Figure 6:
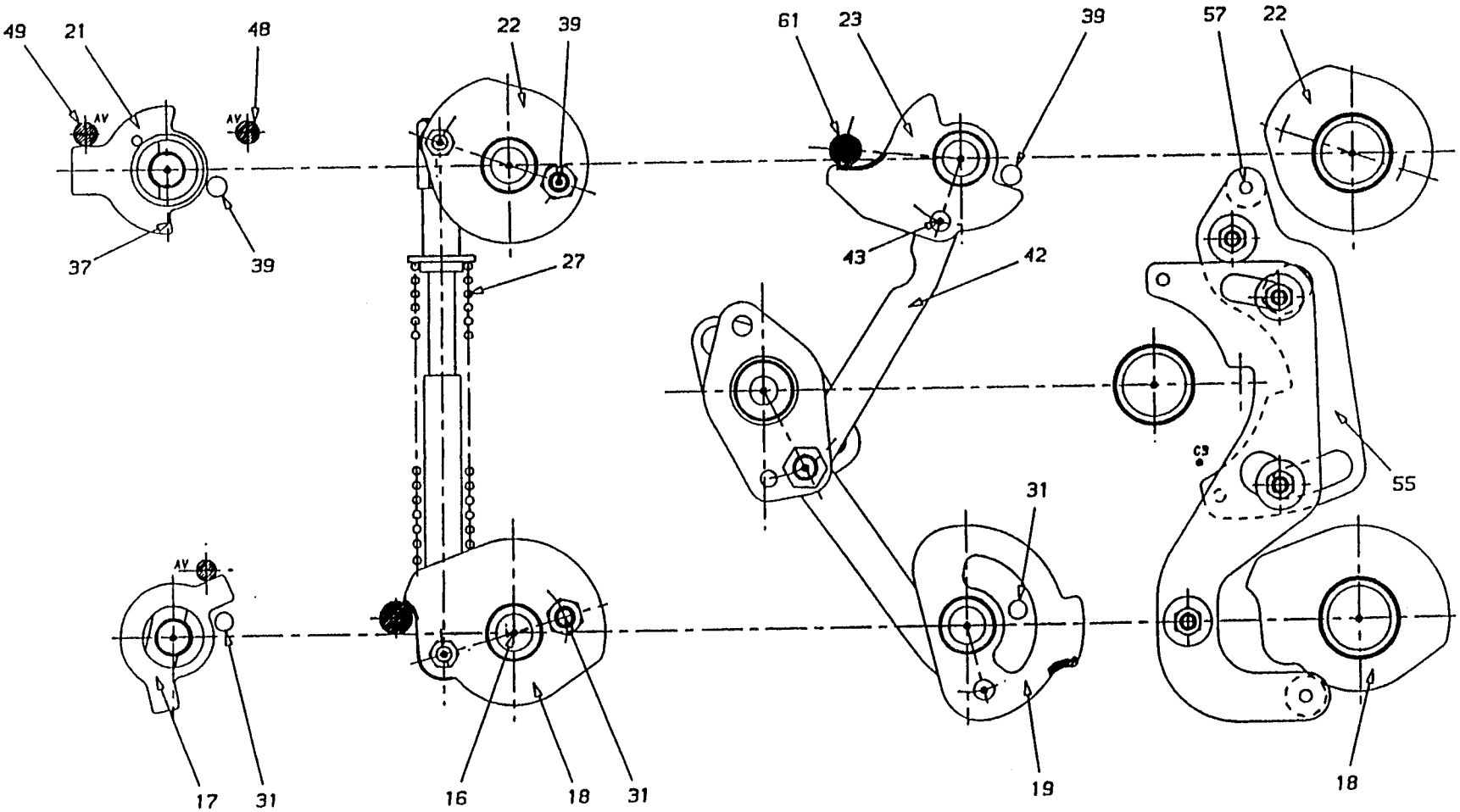

Closing of the earthing device:

Starting from the open position represented in FIG. 2, the operating lever merely has to be coupled to the driver 21 and the latter turned clockwise to move the spindle 39 and pair of flange plates 22 in a clockwise direction (FIG. 5). During the loading phase of the spring 27, the spindle 39 does not act on the sector 23, the stopping surface 41 being engaged only at the end of the loading phase. As soon as the deadpoint is reached, the spring 27 becomes motive and drives the pair of flange plates 22 and, via the spindle 39 bearing against the stopping surface, the sector 23 clockwise at high speed. This rotation is transmitted by the articulated lever 42 to the crank handle 32 and main shaft 10 which pivot together clockwise to the earthing position represented in FIG. 6. This pivoting is enabled by the withdrawal of the locking surface 59, which takes place at the end of the loading phase of the spring 27 due to the action of the cam 58 on the roller 57. In the closed position of the earthing device, the toggle levers 43 are almost aligned and rotation of the sector 23 is limited by a stop 61. This alignment prevents any reverse pivoting of the crank handle 32 and it can easily be seen that in the manner described above the torque transmitted to the crank handle 32 has increased in the course of the closing movement of the earthing device. The articulated lever 33 has transmitted to the sector 19 a limited movement enabled by the aperture 62, the other components of the switch closing device remaining in their original position. In the earthing position represented in FIG. 6, an action on the sector 19 of the switch operating device can only accentuate closing of the earthing device.

Opening of the earthing device:

Counterclockwise rotation of the driver 21 causes the spindle 39 to be driven by the stopping surface 37 and loading of the spring 27 by counterclockwise rotation of the pair of flange plates 22. As soon as the deadpoint is reached, the spring 27 drives the pair of flange plates 22 and sector 23 at high speed in counterclockwise rotation bringing the crank handle 32 to its open position. The locking device returns to the original position on either side of the crankpin 24 preventing any rebound in the manner indicated above. The stops 46, 48, 49 limit the movements of the drivers 17, 21 in order to prevent any operating errors.

The switch opening and closing control can be automated by coupling a motor, which may for example be electric, to the driver 17, and which is capable of moving the driver 17 in rotation in one direction or the other. It can easily be seen that the action of the motor stops at the end of the loading phase of the spring 27 during the closing travel represented in FIG. 3. Further, after the power supply to this motor has been interrupted at this moment, the motor can continue to rotate by inertia without catching up the spindle 31 moved at high speed by the spring 27. Likewise during the opening travel, the motor rotates in the opposite direction and moves the spring 27 to the loaded position before being stopped by interruption of the power supply while continuing its travel by inertia without hindering the opening movement.

An additional interlock is advantageously achieved by an arm preventing operating levers from being placed simultaneously on the shafts 16, 20. By lengthening the aperture 62 or separating the stopping surfaces 40, 41, a shock effect can be obtained that can break the bonding or inertia forces of the mechanism.

The invention is naturally in no way limited to the embodiment particularly described, but extends to cover any alternative embodiment, notably wherein the stopping surfaces 40, 41 are replaced by an aperture similar to the aperture 62. Inversely, the aperture could be replaced by stopping surfaces and the operating shaft could be securedly united to the driver or to one of the other parts mounted with rotation on this shaft.

We claim:

1. An operating mechanism of an electrical switch having movable contacts, comprising:

a main shaft (10) cooperable with movable contacts of said switch, said main shaft (10) rotatable between an open central position (C1) a closed position (C2) and a ground position (C3), wherein said open central position (C1) is located rotatably between said closed position (C2) and said ground position (C3);

a first closing and opening device (14) for rotating said main shaft (10) between said central position (C1) and said closed position (C2) said first closing and opening device (14) including a first rotatable shaft (16) on which is disposed a first flange plate (18) having a first eccentric crank pin (24);

a second closing and opening device (15) for rotating said main shaft (10) between said central position (C1) and said ground position (C3), said second closing and opening device (15) including a second rotatable shaft (20) on which is disposed a second flange plate (22) having a second eccentric crank pin (25);

toggle lever means (19,33,23,42) connecting said main shaft (10) with said first and second closing and opening devices (14,15);

a spring (27) fitted between said first and second eccentric crank pins (24,25) so as to provide torque for rotation of said main shaft (10) via said toggle lever means (19,33,23,42) between said open position (C1) and closed position (C2), and between said open position (C1) and ground position (C3).

2. The device of claim 1, further comprising a first dead travel coupling (29,30,31) and a second dead travel coupling (37,38,39) arranged between said first rotatable shaft (16) and said first flange plate (18), and between said second rotatable shaft (20) and said second flange plate 22), respectively, wherein said first flange plate (18) is movable independent of said first rotatable shaft (16) and said second flange plate (22) is movable independent of said second rotatable shaft (20) upon relaxation of said spring (27).

3. The device of claim 2, wherein said first dead travel coupling (29,30,31) is defined by a first pair of stops (29,30) arranged on opposite sides of a first spindle (31), and said second dead travel coupling (37,38,39) is defined by a second pair of stops (37,38) arranged on opposite sides of a second spindle (39).

4. The device of claim 1, further comprising a first stop (44) and a second stop (45) for limiting rotation of said first and second flange plates (18,22), respectively, said first and second stops (44, 45) defining a relaxed position of said spring (27).

5. The device of claim 1, further comprising dead travel means (31,62; 39,40,41) respectively connecting said first and said second flange plates (18,22) with first and second sector elements (19,23) of said toggle lever means (19,33,23,42) such that said first and second sector elements (19,23) are uncoupled from said first and second flange plates (18,22) via said dead travel means (31,62; 39,40,41) while loading said spring (27) by rotating said first and second flange plates (18,22), said first and second sector elements (19,23) being coupled with said first and second flange plates (18,22) during relaxation of said spring (27) thereby driving said first and second sector elements (19,23) and said main shaft (10).

6. The device of claim 5, further comprising a crank handle (32) disposed on said main shaft (10), said crank handle (32) being connected to first and second levers (33,42) of said toggle lever means (19,33,23,42) via a toggle (34), said first and second sector elements (19,23) cooperating with stop means (60,61) thereby defining said closed and ground positions (C2,C3), said stop means (60,61) positioned such that said closed and ground positions (C2,C3) are self-locked.

7. The device of claim 1, further comprising first and second operating cams (53,58) disposed on said first and second flange plates (18,22), respectively, said first and second operating cams (53,58) being cooperable with stopping surfaces (54,59) which lock said main shaft (10) in said central position (C1), wherein rotation of one of said first and second flange plates (18,22) causes unlocking of said main shaft (10) by a corresponding one of said first and second operating cams (53,58).

* * * * *